US005748087A

United States Patent [19]

Ingargiola et al.

[11] Patent Number: 5,748,087

[45] Date of Patent: May 5, 1998

[54] REMOTE PERSONAL SECURITY ALARM SYSTEM

[76] Inventors: Thomas R. Ingargiola, 432 Peters Blvd., Brightwaters, N.Y. 11718; William Milidantri, 127 Suffolk Ave., North Babylon, N.Y. 11704

[21] Appl. No.: 701,499

[22] Filed: Aug. 1, 1996

[51] Int. Cl.[6] ..... G08B 21/00

[52] U.S. Cl. ..... 340/573; 340/539; 340/693

[58] Field of Search ..... 340/573, 539, 340/693

[56] References Cited

U.S. PATENT DOCUMENTS

| | | | |
|---|---|---|---|
| 4,593,273 | 6/1986 | Narcisse | 340/539 |
| 4,598,272 | 7/1986 | Cox | 340/573 |
| 5,086,290 | 2/1992 | Murray et al. | 340/539 |
| 5,115,223 | 5/1992 | Moody | 340/573 |
| 5,264,828 | 11/1993 | Meiksin et al. | 340/539 |
| 5,289,163 | 2/1994 | Perez et al. | 340/539 |
| 5,343,190 | 8/1994 | Rodgers | 340/573 |
| 5,365,217 | 11/1994 | Toner | 340/539 |
| 5,500,635 | 3/1996 | Mott | 340/323 R |
| 5,557,259 | 9/1996 | Musa | 340/573 |

FOREIGN PATENT DOCUMENTS

| | | |
|---|---|---|
| 335467 | 10/1989 | European Pat. Off. . |
| 2121219 | 12/1983 | United Kingdom . |

*Primary Examiner*—Glen Swann

*Attorney, Agent, or Firm*—Richard C. Litman

[57] ABSTRACT

A remote monitoring system, particularly useful in monitoring the position of a child or Alzheimer's patient, has a first unit including a handheld portable transmitter and receiver; and a second unit including two identical sections, wherein each section is carried in one of a footwear pair, and each section has a transmitter and receiver. The transmitter of the first unit has a selective switch for on-demand transmission of a find signal. The transmitters of the second unit each continuously emits a location signal. The receiver of the first or handheld unit is responsive to one of or both location signals. The handheld unit generates an audible alarm indicating that the person wearing the footwear has gone beyond a preset distance from the first or handheld unit. The receivers of the second unit each receive the find signal generated by the first unit, and in response thereto, actuates a plurality of illuminating devices, such as LEDs in the soles of the footwear as well as actuating an audio alarm from the footwear.

12 Claims, 4 Drawing Sheets

REMOTE PERSONAL SECURITY ALARM SYSTEM

BACKGROUND OF THE INVENTION

1. Field of the Invention

The present invention relates to a remote personal security system. More specifically, the invention is a system for monitoring the whereabouts of a person incapable of identifying their location within a limited proximity; and alarming both the person and a overseer via a remote alarm device.

2. Description of the Prior Art

The prior art purports numerous devices for alerting a parent or guardian when a child exceeds boundary limits. For example, U.S. Pat. No. 5,289,163, issued Feb. 22, 1994 to Perez et al., discloses an alarm system that provides a continuous signal emitted from a transmitter carried by a child, and a remoter receiver carried by the parent. The receiver, via a triangulation process, alarms the parent when the child has left a predetermined proximity range, and provides a general indication of the direction the child has gone. U.S. Pat. No. 5,086,290, issued Feb. 4, 1992 to Murray et al, discloses a transmitter carried by the monitored person, and a receiver carried by the monitoring person; the transmitter emits a coded range signal, the receiver has IN/OUT range determination and tracking modes. U.S. Pat. No. 5,115,223, issued May 19, 1992 to Moody, discloses a self contained residential monitoring and tracking system for monitoring whether an individual (e.g., an Alzheimer's patient) has exceeded a predetermined boundary limit and for indicating the direction the individual strayed. U.S. Pat. No. 5,264,828, issued Nov. 23, 1993 to Meiksin et al. and U.S. Pat. No. 5,365,217, issued Nov. 15, 1994 to Toner, each discloses a carrier actuated emergency signal transmitter for alerting authorities during medical or physical emergencies. U.S. Pat. No. 5,343,190, issued Aug. 30, 1994 to Rodgers, discloses novelty type footwear having lights and/or sounds. U.S. Pat. No. 5,500,635, issued Mar. 19, 1996 to Mott, discloses a piezoelectric sensor for actuating light elements in various articles. E.P.O. Patent Document No. 335,467, published Oct. 4, 1989 to Heister et al., discloses lighted footwear. United Kingdom Patent Document No. 2,121,219, published Dec. 14, 1983 to Wu, discloses footwear having cadence pacing and distance counting features.

None of the above inventions and patents, taken either singly or in combination, is seen to describe the instant invention as claimed.

SUMMARY OF THE INVENTION

The prior art provides many efforts to monitoring the whereabouts, within a predetermined range, of an individual. More often the primary purpose of these devices are for monitoring children while with their parents or guardians. Other types of devices are also often used, such as leash like tethers, matching apparel, etc. Applicant has found that though the prior art devices offer some security, it is more important to have a complete sense of security. Specifically, applicant has found that the present invention will serve as a greater deterrent to child abduction and as a remedy for lost children. Additionally, the present will stop child abduction in the first few moments a child is seized.

Accordingly, it is a principal object of the invention to provide a system for monitoring the location of an individual within a predetermined boundary range.

It is another object of the invention to provide a system for monitoring the location of an individual within a predetermined boundary range having visual and audio alarms.

It is a further object of the invention to provide a system for monitoring the location of an individual within a predetermined boundary range having visual and audio alarms at both the monitoring individual and the monitored individual.

Still another object of the invention is to provide a system for monitoring the location of an individual within a predetermined boundary range having visual and audio alarms at both the monitoring individual and the monitored individual; where the monitored individual has a pair of the visual and audio alarms.

It is a further object of the invention to provide a system for monitoring the location of an individual within a predetermined boundary range having visual and audio alarms at both the monitoring individual and the monitored individual; where the monitored individual has a pair of the visual and audio alarms strategically located integral with the footwear.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
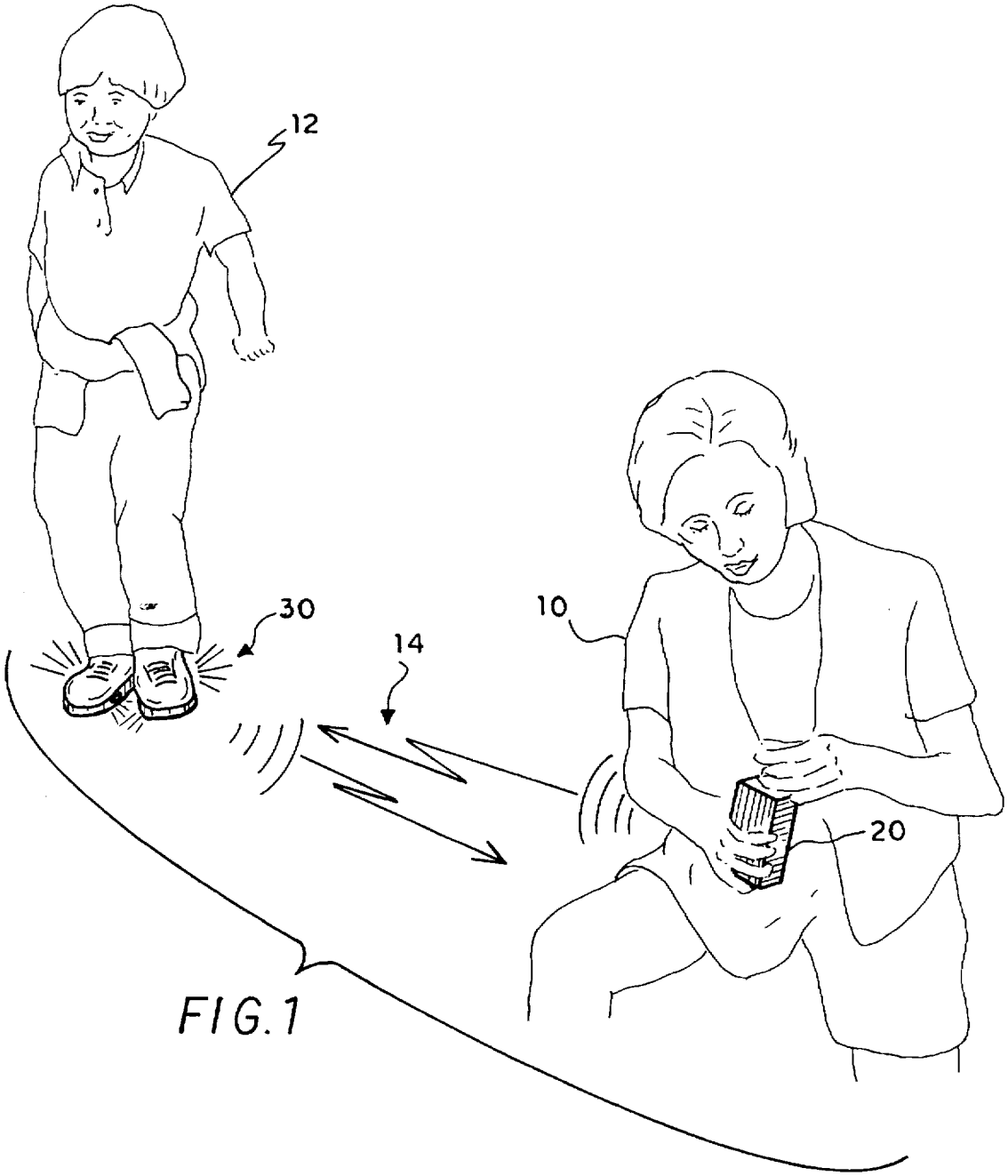
FIG. 1 is an environmental view of the present invention in use, e.g., by a parent and a child.

The present invention provides security for parents or care-givers to those who are less likely to understand the immediate environment may be hostile. Referring to FIG. 1, a parent 10 of child 12 can monitor the whereabouts of the child 12 in a crowded environment, such as playground, park, mall, airport, etc. The parent 10 has a radio frequency link 14 with the child 12. This RF link 14 sounds audible and visual alarms at the parent 10 having a first housing unit 20 and simultaneously actuates audible and visual alarms at the child 12 having footwear 30 equipped with such. In this, the preferred embodiment, the visual alarms are brightly flashing red Light Emitting Diodes (LEDs). Also, the audible alarms of the preferred embodiment are electronically produced warbling, modulating, or beeping tones.

Figure 4:
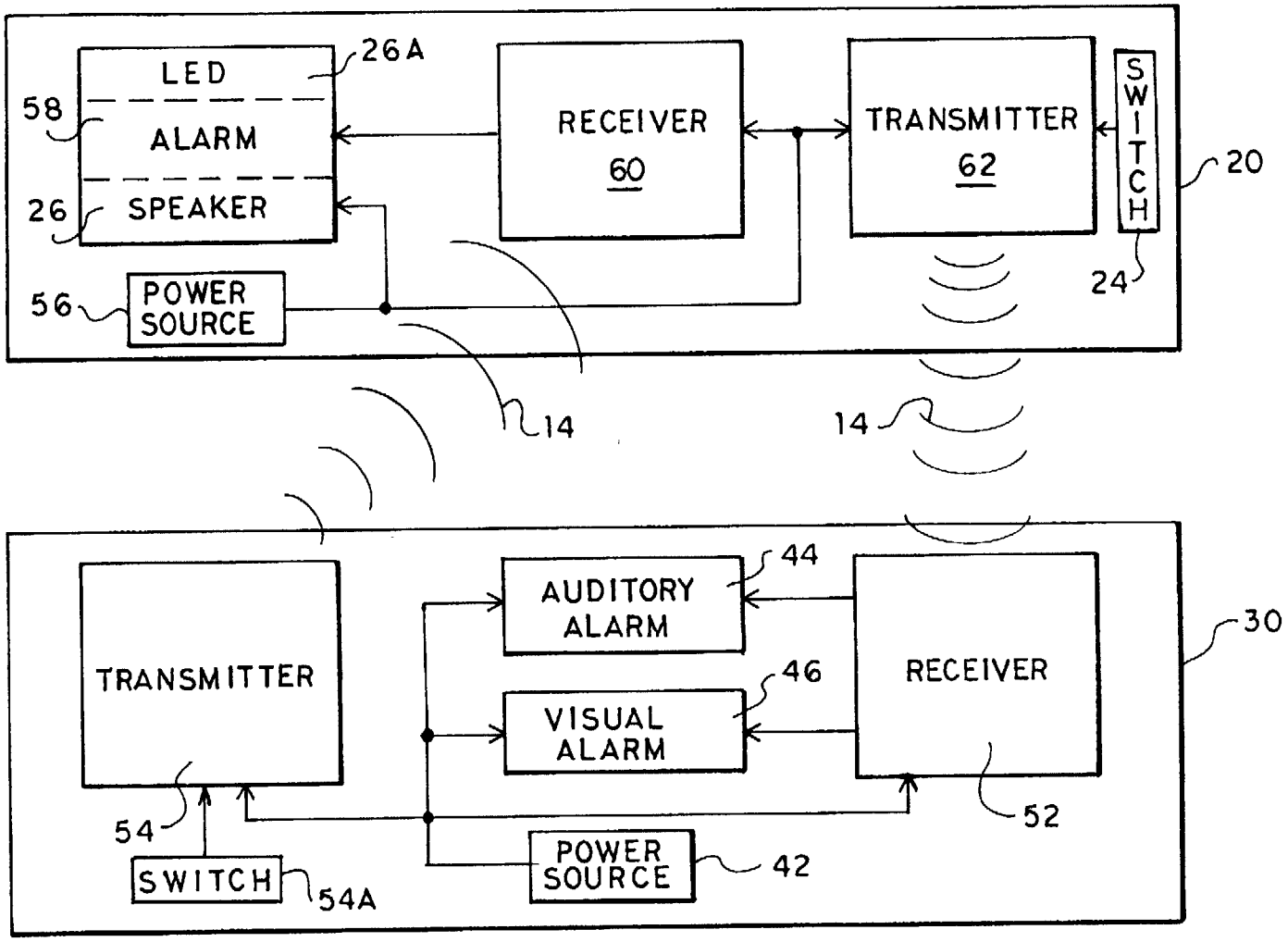
FIG. 4 is a block diagram of the present invention.

Referring to FIG. 4 the operation of the system of the present invention is set forth. Handheld unit 20 is generally a compact portable device. The handheld unit 20 internally houses a power source 56 for supplying the necessary electrical power to the components discussed herein. The unit also include an RF transmitter 62 that emits a "find" signal, preferably in the FM band, on demand via the pushbutton switch 24, to the second unit 30. The second unit 30 includes two identical sections, each section carried as an integral part of the footwear. For illustrative purposes only one section of second unit 30 is shown. The handheld unit 20 also includes a receiver 60 that receives a "location" signal from either one or both sections of the second unit 30.

Upon receipt of a "location" signal, the receiver 60 actuates an alarm device 58, which produces an audible sound signal via speakers 26 and a visual signal via LED 26A.

It is also noted, that the receiver 60 of the handheld unit 20 is particularly responsive to a simultaneously received signal from both footwear sections for generating the alarm indications. Specifically, each section of the second unit is provide with a pushbutton type switch 54A. These switches 54A, when pushed, actuate the transmitters to send a predetermined specified "location" signal to receiver 60. Upon receipt of the specified "location" signal, the handheld unit 20 produces a higher frequency alarm alerting the parent 10 that the child 12 is in trouble. This feature provides the child 12 with the ability to call the parent 10 on demand if the child 12 finds himself lost or abducted.

Each section of the second unit 30 has a receiver 52 that is responsive to the transmitted "find" signal. Upon receipt of the "find" signal, an auditory alarm 44 via speakers (note FIG. 2) is generated. Likewise, a visual alarm 46 via LEDs (note FIG. 2) is illuminated. Also, each section of unit 30 has a respective RF transmitter 54 that generates the "location" signal, preferably in the FM band. It is conventional in the art to use different frequencies and frequency modulations within the allowed FM band so that each individual system operates independently without any interference from any other system of the present invention. All the components of each section of second unit 30 are energized by a power source 42.

Figure 3:
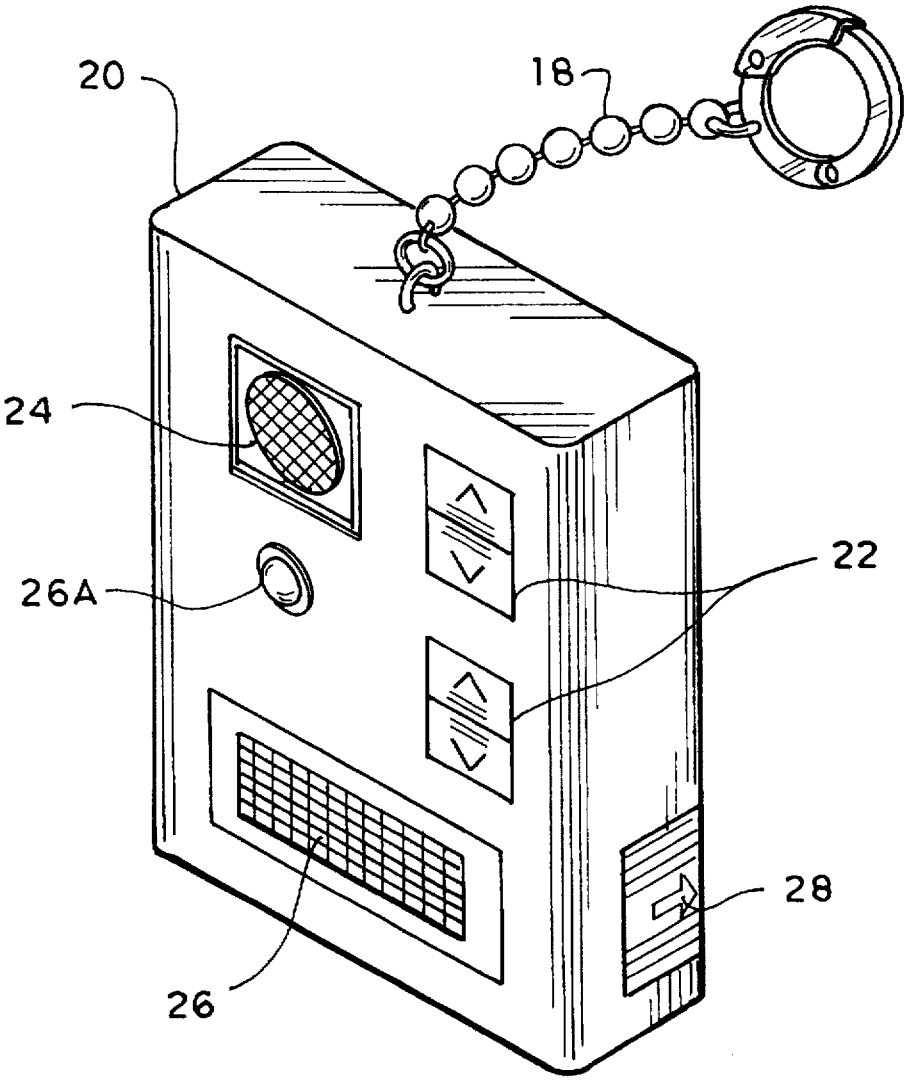
FIG. 3 is a perspective view of the handheld unit portion of the present invention.

As seen in FIG. 3, the handheld unit 20 is as a compact rectangular box housing. On the top of the unit 20 is a key chain and ring 18. It is understood that the key chain and ring 18 is an optional feature, any other feature (including none) is solely at the discretion of the artisan. The front of unit 20 has a pushbutton switch 24 for on demand actuation of the transmitter 62. In addition, the front of unit 20 supports a pair of controls 22, a first control establishes the range boundary limit in predetermined increments. For example, the incremental change is ten feet, then by pressing the control upwards increases the boundary range by ten feet (i.e., if the default range is 20 feet, then pressing the control upwards three times increases the range to 50 feet). Likewise, pressing the control downwardly decreases the range by the specified increment. The range adjustment control operates the transmission power of the transmitter 62 and the sensitivity of receiver 60. The other control adjusts the volume of the auditory alarm 58 outputted through the speaker 26. Illustratively shown on the side of unit 20 is an access cover for replacing the battery for power supply 56.

Figure 2:
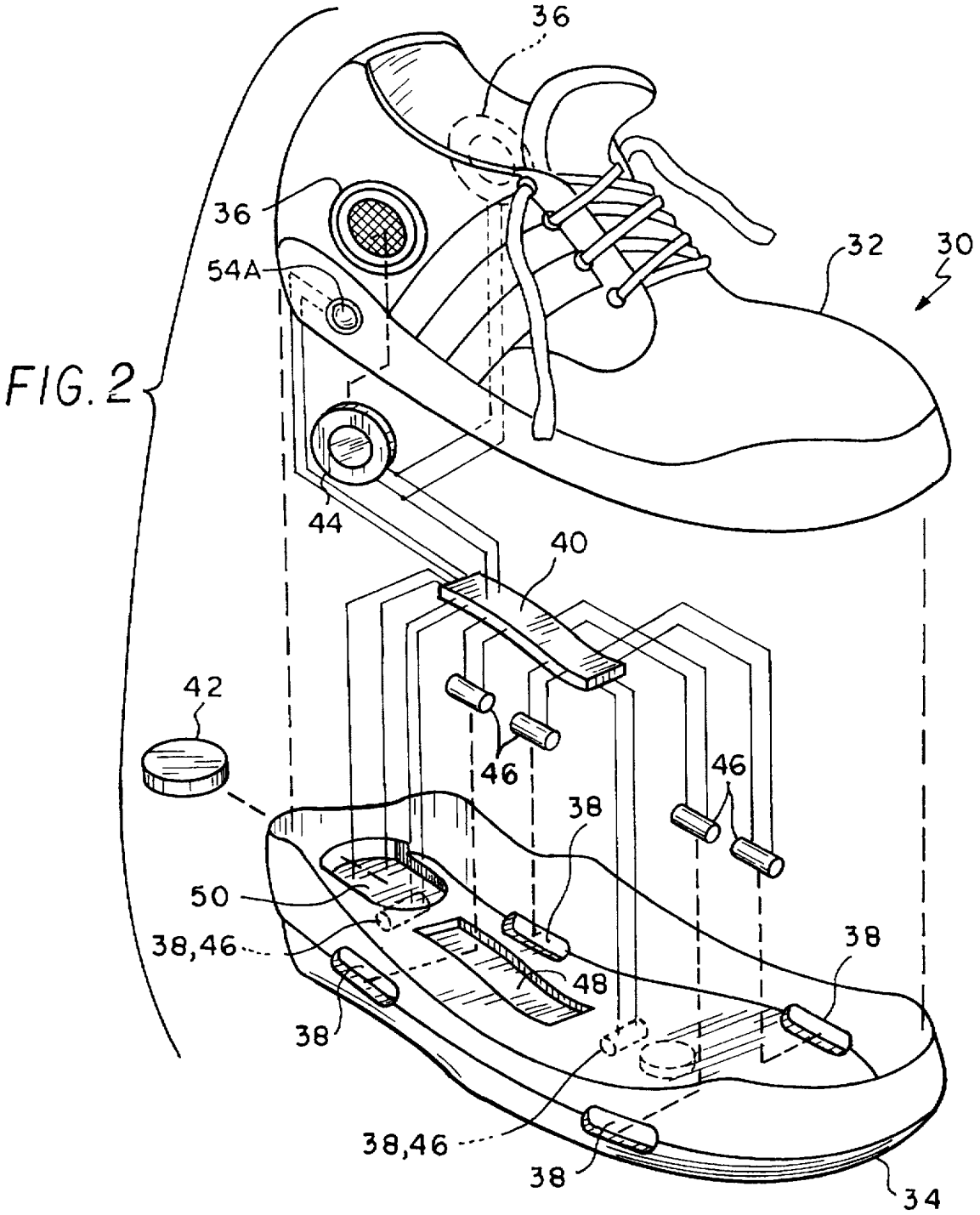
FIG. 2 is an exploded perspective view of one shoe of a pair of shoes utilizing the system of the present invention.

Referring to FIG. 2, the second unit 30 of the system is shown, although only a single section (i.e., one shoe of a pair) is set forth. It is understood that the second section (i e., the other shoe will have the same components and configuration as illustrated and described with reference to this figure. The second unit 30 generally is a shoe, typically an athletic type shoe however, any type of footwear is suitable for the present invention. The shoe has an upper portion 32 and a lower or sole portion 34. The lower or sole portion 34, is generally formed of rubber or other synthetic resilient material through a conventional molding process. During such molding process, the majority of the components are arranged and disposed in the lower or sole portion 34. A circuit board 40 is secured in a circuit board chamber 48. Also, a battery for the power supply 42 is deposited in a battery chamber 50. Additionally, in an easily accessible location on each shoe, preferably shown in the heel region of the upper, pushbutton type switch 54A is disposed. The switch 54A provides the transmission of the specified "location" signal. Optionally, another switch (not shown) is provided in each section of the second unit for turning the power on or off for battery conservation.

The visual alarm, in the preferred arrangement, consists of six LEDs 46 (preferably red flashing type) that are disposed in transparent or near transparent ports 38. The ports 38 are positioned about the lower or sole portion 34 so as to afford the highest possible visibility when illuminated. Thus the ports 38 are preferably set as two in the bottom, and two on each side of the shoe. The two in the bottom allow the parent (or passerby) 10 to see the illuminated LEDs 46 as the child 12 moves away. The side LEDs 46 aid in the visual location of the child 12 by alerting passersby that the child 12 is being sought by the parent (or guardian) 10 holding the handheld unit 20.

The upper portion 32, conventionally formed of any suitable material (e.g., canvas, leather, rubber, or synthetic), according to conventional formation processes. During the formation process of the second unit 30, a pair of speakers 44 are mounted therein, at a position illustratively shown as speaker ports 36. The speakers 44 emit an audible signal that can be heard several tens of feet away. Additionally, the receiver 60 of the handheld unit 20 provides a demand signal to the transmitter 62 for actuating the transmitter 62. Thus, sending a signal to the second unit 30 whenever a signal is received from the second unit 30 indicating the boundary limit has been crossed.

It is to be understood that the present invention is not limited to the sole embodiment described above, but encompasses any and all embodiments within the scope of the following claims.

We claim:

1. A radiant energy communication system between at least two carriers for remote signalling when one of the carriers exceeds predetermined boundary limits comprising:

primary transmitter means coupled to a first carrier for emanating a find signal, having a demand actuator for causing said find signal to emanate;

first and second primary receiver means coupled to a second carrier each receiving said find signal emanated from said primary transmitter means and each generating a respective alarm signal in response to said received find signal; and first and second primary alarm means coupled to each of said first and second primary receiver means, each receiving said respective alarm signal and each generating respective alarms in response thereto.

2. The system according to claim 1, said first and second primary receiver means, each with respective said first and second primary alarm means being integrally formed in each of a pair of footwear apparel, respectively, wherein the footwear is worn by the second carrier.

3. The system according to claim 2, said demand actuator being switch means; said alarms being audio and visual indicators.

4. The system according to claim 1, further comprising:

first and second secondary transmitter means coupled to the second carrier, each continuously generating a location signal;

secondary receiver means coupled to the first carrier for receiving any one of said first secondary transmitter location signal, said second secondary transmitter location signal, and both said first and second secondary transmitter location signals, and generating a secondary alarm signal in response thereto when the received signals indicate said boundary limits have been exceeded; and secondary alarm means for generating an audio alarm indicative of the received location signals, said audio alarm of said secondary alarm means being representative that the second carrier has exceeded said predetermined boundary limits.

5. A system according to claim 4, further comprising:

first adjustment means for selectively establishing the range of the predetermined boundary limit; and second adjustment means for selectively establishing the volume level of said audio alarm of said secondary alarm means.

6. A radio frequency communication system between at least two persons for remote signalling when one of the persons exceeds a predetermined boundary limit comprising:

first housing means carried by the first person having: primary transmitter means for emanating a find signal, having a demand actuator for selectively causing said find signal to emanate;

secondary receiver means for receiving any one of a first secondary transmitter location signal, a second secondary transmitter location signal, and both said first and second secondary transmitter location signals, and generating a secondary alarm signal in response thereto when the received signals indicate said boundary limits have been exceeded; and secondary alarm means for generating an audio alarm responsive to said secondary alarm signal;

second housing means worn by the second person having:

first and second primary receiver means for receiving said find signal emanated from said primary transmitter means and for generating a primary alarm signal in response to said received find signal;

first and second primary alarm means respectively coupled to said first and second primary receiver means, each receiving said respective alarm signal and each generating a respective alarm in response thereto;

first and second secondary transmitter means each continuously generating a location signal, whereby said first primary receiver means, said first primary alarm means, and said first secondary transmitter are integrally contained in a first shoe worn by the second person; and said second primary receiver means, said second primary alarm means, and said second secondary transmitter are integrally contained in a second shoe worn by the second person.

7. The system according to claim 6, said demand actuator being switch means; said alarms being audio and visual indicators.

8. A system according to claim 7, further comprising:

first adjustment means for selectively establishing the range of the predetermined boundary limit; and second adjustment means for selectively establishing the volume level of said audio alarm of said secondary alarm means.

9. A radio monitoring system between at least two moveable objects for remote signalling when one of the moveable objects exceeds predetermined boundary limits comprising:

first and second secondary transmitter means coupled to the second moveable object, each continuously generating a location signal;

secondary receiver means coupled to the first moveable object for receiving any one of said first secondary transmitter location signal, said second secondary transmitter location signal, and both said first and second secondary transmitter location signals, and generating a secondary alarm signal in response thereto when the received signals indicate said boundary limits have been exceeded; and secondary alarm means for generating an audio alarm responsive to said secondary alarm signal, wherein said audio alarm of said secondary alarm means being representative that the second moveable object has exceeded said predetermined boundary limits.

10. A system according to claim 9, further comprising:

first adjustment means for selectively establishing the range of the predetermined boundary limit; and second adjustment means for selectively establishing the volume level of said audio alarm of said secondary alarm means.

11. The system according to claim 9, further comprising:

primary transmitter means coupled to the first moveable object for emanating a find signal, having a demand actuator for causing said find signal to emanate;

first and second primary receiver means coupled to the second moveable object for receiving said find signal emanated from said primary transmitter means and for generating an alarm signal in response to said received find signal; and first and second primary alarm means respectively coupled to each of said first and second primary receiver means, each receiving said respective alarm signal and each generating a respective alarm in response thereto.

12. The system according to claim 11, said demand actuator being switch means; said alarms being audio and visual indicators.

* * * * *